US012566007B2

(12) United States Patent
Chaudhuri

(10) Patent No.: US 12,566,007 B2
(45) Date of Patent: Mar. 3, 2026

(54) FILTER REGENERATING APPARATUS

(71) Applicant: Sid Chaudhuri, East Brunswick, NJ (US)

(72) Inventor: Sid Chaudhuri, East Brunswick, NJ (US)

( * ) Notice: Subject to any disclaimer, the term of this patent is extended or adjusted under 35 U.S.C. 154(b) by 0 days.

(21) Appl. No.: 18/755,619

(22) Filed: Jun. 26, 2024

(65) Prior Publication Data

US 2026/0002686 A1 Jan. 1, 2026

(51) Int. Cl.
*F24F 11/39* (2018.01)
*F24F 8/90* (2021.01)

(52) U.S. Cl.
CPC ..... *F24F 11/39* (2018.01); *F24F 8/90* (2021.01); *F24F 2221/02* (2013.01)

(58) Field of Classification Search
None
See application file for complete search history.

(56) References Cited

U.S. PATENT DOCUMENTS 6,269,519 B1 * 8/2001 Harvey ..... F23J 3/026 15/387
8,146,376 B1 * 4/2012 Williams ..... F24F 11/39 236/46 C
10,590,593 B1 * 3/2020 Leibman ..... A47L 7/009
2006/0138039 A1 * 6/2006 Rudolf ..... B01D 25/24 210/407
2008/0083333 A1 * 4/2008 Yokoi ..... B01D 46/0056 55/385.2
2010/0077926 A1 * 4/2010 Yamagishi ..... B03C 3/64 96/423
2012/0323374 A1 * 12/2012 Dean-Hendricks ..... F24F 11/61 700/276
2019/0277180 A1 * 9/2019 Dudar ..... F01N 3/023
2021/0362085 A1 * 11/2021 Eichner ..... B01D 46/69

OTHER PUBLICATIONS

Jeon, Seung Woo, et al. "Design of an intelligent duct cleaning robot with force compliant brush." 2012 12th International Conference on Control, Automation and Systems. IEEE, 2012. (Year: 2012).*

* cited by examiner

*Primary Examiner* — Carlos R Ortiz Rodriguez

(57) ABSTRACT

The present invention provides a filter regenerating apparatus comprising a dust load measurement unit, a control unit, and a vacuum cleaning device. The control unit activates the load measurement unit to measure the dust load on the filter and activates the vacuum cleaning device to vacuum clean the filter if the measured quantity of dust load exceeds a threshold value. The load measurement unit measures the quantity of dust load again after the filter is cleaned. If the dust load is still not lowered below the threshold value, then the system sends a filter replacement message to a user device. The efficiency of an air filter is best when it is neither new nor too dirty. By vacuum cleaning the filter in situ and by selecting an appropriate load threshold value, the filter can be used not only for a longer period but also with highest efficiency.

21 Claims, 14 Drawing Sheets

1106

FILTER REGENERATING APPARATUS

FIELD OF THE INVENTION

This invention generally relates to air filters to capture airborne particulates in air handling systems such as HVAC (Heating, Ventilation and Airconditioning), vehicles, dryers, and computer and server systems, and specifically to clean the filters while in operation based on filter blockage criteria.

BACKGROUND OF THE INVENTION

This invention relates to an air filter system that cleans and regenerates a dirty filter in situ triggered by a predetermined level of dust loaded on the filter.

Air filters are used in a variety of systems to trap and remove undesirable particulates from an air stream in an air circulation system. Air filters are typically installed in the path of the air stream contained in an enclosure, conduit or duct in the air circulation system to capture dust and other undesirable particulates and to allow clean air to flow into the system. Examples of such applications include HVAC systems at residential and commercial buildings, vehicles, dryers, computer/server systems, and manufacturing equipment.

A filter structure includes a frame in which a semipermeable membrane is attached. The structure of the frame can be a simple frame like a picture frame. Some filters may have more elaborate shapes. For example, a vehicle filter may have an accordion like frame in which multiple fins or membranes are attached so that air passes through all of them increasing the level of cleanliness of the air that passed through such multi-membrane filters. A filter can have a circular shape in which membranes are attached in a cylindrical pattern. The filter membrane is made from a variety of materials including paper, cloth, plastic fibers, and other synthetic fibers. Examples of membrane types include polytetrafluoroethylene (PTFE), polyvinylidene difluoride (PVDF), nylon, cellulose acetate, polypropylene, polyethersulfone (PES), track etched polycarbonate, and mixed cellulose ester (MCE).

As more air passes through a filter more debris accumulates over time in the filter resulting in significant blockage of the airflow through the filter. Henceforth the amount of dust or debris in weight accumulated per unit area on a filter will be called the filter load, dust load or simply load. The blockage of the filter causes air flow to diminish and to reduce the effectiveness of the air circulation system. Additionally, a clogged filter may dislodge some of the captured debris into the area for which the filter is used to supply clean air resulting in adverse health effect on users.

As a result, air filters used in air circulation systems need to be replaced or cleaned when there is significant blockage. Typically filter manufacturers recommend a certain period of usage when the filters should be regularly replaced or cleaned. For example, it is recommended that residential HVAC system filters are replaced every three months. The recommendations are based on average usage conditions. It does not consider specific situations such as ambient air quality, health requirements for specific users such as allergy, seasonal usage time, etc. In addition, users must remember when the replacements are due and carry out the replacements accordingly. Quite often users forget. Consequently, filters are generally replaced prematurely or too late for the most effective operation of the air circulation systems.

Attempts have been made previously to provide more effective air filter systems addressing the problems mentioned above. Examples of such attempts are found in the U.S. Pat. Nos. 4,751,501, 5,772,711, 6,052,058, 6,320,513, 6,412,435, 6,443,010, 7,261,762, 7,726,186, 8,314,710, 9,080,784, 9,366,448, and 10,513,997. These systems require measurement of the differential airflows on two sides of a filter, detection of airflow reduction compared to a baseline airflow, measurement of noise created by a whistle installed in the filter that creates noise or vibration when sufficiently blocked, detection of back pressure caused by resistance to airflow when the filter is clogged, detection in rise of the temperature of an equipment not receiving sufficient airflow due to a clogged filter, etc. Some of the systems provide means for generating alert in the form of a sound signal such as a whistle or a light indicator. Other systems provide alerts that a filter needs to be replaced. There are several drawbacks of these systems. First, the devices to detect filter blockage by means of airflow, sound, or pressure differential etc. are not very accurate. Second, the alerts are generated based on a fixed amount of blockage that cannot be adjusted according to the need of specific users. Third, users still need to actively look for alerts for filter replacements.

The above-mentioned problems have been solved and a novel solution for filter monitoring based upon direct measurement of filter status using photosensors, smart algorithms for signal processing to study the feasibility of accurate filter condition determination using sensor data, and Internet of Things (IoT) for control and communication has been provided in U.S. Pat. Nos. 10,864,471 and 11,235,272.

Contrary to common intuition, a new filter is less efficient in arresting dust particles than a dirty filter. A new filter allows more of the dust particles, particularly the smaller size particles through the filter membrane. As more dust particles accumulate on the larger holes in the filter membrane gets smaller by the accumulated dust particles. As a result, the filter arrests more of the dust particles as it is used more and gets dirtier in the air handling systems and the filter efficiency increases as it is used more. This observation may lead to the conclusion that a filter should not be replaced at all. However, as the filter gets dirtier it also increasingly blocks air passage. When the air flow diminishes to a critical level then the filter's true function of circulating air while arresting dust particles is inhibited. Thus, there is a critical range of dust loading on the filter when air flows without significant blockage and still arrests more of the dust particles compared to a new filter. This critical range of dust load is the sweet spot for the filter condition for its efficient usage in an air handling system. However, currently there is no solution to determine the sweet spot and to keep operating the filter in the sweet spot of the dust load without removing the filter from the air handling system.

Thus, there is a need for a filter regenerating system to determine the most efficient rage of the filter load for its usage and to regenerate the filter without removing it from the air handling system and lower the level of dust load so that the filter continues to operate within the efficient range or the sweet spot as discussed earlier and hence the filter always remains in a high air cleaning efficacy state.

SUMMARY OF THE INVENTION

The present invention provides systems and methods to measure a filter load, to determine an efficient range of the filter load, and to regenerate the filter in situ when the measured load exceeds an upper limit of the efficient range so that the air filter used in a variety of systems including residential and commercial HVAC systems, vehicles, dryers, and computer and server systems always remains in its most efficient performance state. The system will not only increase efficiency but also will extend the lifetime of the filter.

In accordance with the present invention, a filter regeneration apparatus comprises a housing, a filter load measurement unit, a control unit, a movable door, a door actuator to move the door, and a filter regeneration unit. A door can be a solid flat plate made of metal, plastic or any composite material that is impermeable to air. The housing incorporates the filter load measurement unit, the door actuator, the control unit, and the doors. The control unit comprises a logic circuit, a central processing unit (CPU) or a microcontroller unit (MCU) and a memory. The control unit activates the actuators to slide the door through grooves in the housing on an external command or the execution of a program logic stored in the memory. The direction of the movement of the sliding door can be conveniently selected, for example, vertically up or down and horizontally side to side.

The filter load measurement unit comprises one or more light sources, one or more light sensors, and one or more light source and sensor actuators, hereafter called sensor actuators. The light sources, the light sensors, and the sensor actuators are coupled to the control unit. The light source and the sensor are attached at the ends of two sensor actuator arms of the one or more actuators. The load measurement unit may also further comprise a dedicated second control unit for the functions to be performed by the load measurement unit. Alternatively, the load measurement unit may utilize the apparatus control unit for all its functions.

In one aspect of the invention, the control unit activates the sensor actuators to extend the actuator arms based on an external command or the execution of a program logic stored in the memory to measure the filter load. Upon receiving the measurement command, the control unit activates the sensor actuators to place the light source and the light sensor on opposite sides of the filter. The control unit then turns on the light source and activates the sensor. The light sensor measures the intensity of light received at the sensor. The control unit receives the received light intensity data from the sensor. The control unit commands the sensor actuators to move the source to a new location of the filter and to move the sensor to a location opposite to the new location of the source. The control unit then commands the source to turn on and the sensor to measure the light attenuation at the new location as described above. The control unit commands the sensor actuators, the source and the sensor to take light attenuation data at multiple locations. Once the light attenuation measurements from the multiple locations for a data acquisition session are completed, the control unit commands the sensor actuators to retract the actuator arms along with the light source and the sensor into their original positions so that the filter is no longer blocked by the source, the sensor and the sensor actuator arms after the data session is completed.

In another aspect of the invention, the control unit is programmed to periodically activate the actuators and to measure the light intensity transmitted through the filter. The control unit can also activate the sensor actuators and direct the light sensors to measure the light intensity transmitted through the filter upon receiving an external command. The control unit processes the measured intensity data to determine the filter load and stores the load data in the memory of the control unit. The control unit may perform data analysis such as averaging multiple data points for the determination of the filter load.

In yet another aspect of the invention, the control unit is coupled with a server computer in a cloud system via a wireless network such as a 4G or a 5G cellular network with IoT capability or a WiFi network. The control unit sends measured light intensity data, from which light attenuation data can be calculated, received from the light sensors along with its identification (ID) to the server computer using the IoT network capability. The server computer processes the received light intensity data to determine the filter load.

In yet another aspect of the invention, the filter regeneration apparatus stores in its memory or receives from an external server system a value of the lower limit and a value of the upper limit of a filter load range. The filter regeneration apparatus compares the current measured load with the upper limit of the filter load range called the upper threshold load. When the measured load value reaches or exceeds the upper threshold value, the regeneration apparatus control unit initiates regeneration of the filter.

In yet another aspect of the invention, upon initiation of the regeneration process, the control unit activates the door actuators to move the door from outside to inside of the air handling system where the filter is located. The regeneration apparatus then activates the one or more regeneration units to remove dust or debris accumulated on the filter. The regeneration stops the regeneration units when the filter load of the partially cleaned filter determined by the duration of the regeneration unit's operation reaches or goes below the lower threshold of the efficient load range. The control unit then commands the door actuators to retract the door substantially outside the duct.

In yet another aspect of the invention, the regeneration unit is one or more of: a fan unit, a vacuum device, a vibration unit, a brush, an ultraviolet (UV) light source, and a cleaning chemical agent spraying unit.

In yet another aspect of the invention, two fans, one on each side of the filter, are used. For regeneration, one fan blows air into the filter from the clean side of the filter and the other fan exhausts air out of the filter from the dirty side of the filter causing the dust particles to be more easily dislodged from the filter. An exhaust pipe is attached to the exhaust fan side for the dislodged particles to be removed from the duct either by attaching a filter bag at the other end of the pipe or by releasing the exhaust air along with the dust particles outside the building.

In yet another aspect of the invention, a vacuum cleaner device is used to clean the dirty filter. The vacuum cleaner can be a robotic vacuum cleaning device. The robotic vacuum cleaning device is attached to a robotic arm which is controlled by the regenerator control unit to move the vacuum cleaning device across the surface of dirty side of the filter while suctioning off the dust from the filter surface by the vacuum cleaning device. Alternatively, the vacuum cleaning device is a self-controlled unit including a sensor to detect obstructive objects in its neighborhood. The self-controlled cleaning device uses the sensor to move on the surface of the filter back and forth while vacuum cleaning the surface of the filter. The vacuum cleaning device has a brush which brushes the surface of the filter while being vacuum cleaned by the vacuum cleaning device.

In yet another aspect of the invention, in addition to the fans, a vibration unit is used to loosen the dust particles for the fans to extract them easily. The vibration unit is coupled with the filter. The control unit commands the vibration unit to vibrate or shake the filter to loosen the dust particles. A vibration generator is the core component that produces the vibrations. For example, it can be an electric motor with an unbalanced mass attached to its shaft, creating eccentric motion, or it can be a piezoelectric element that vibrates when an electric current is applied. The vibration unit can include its own control which is necessary to regulate the intensity and frequency of the vibrations. In some designs, sensors or monitoring systems might be included to provide feedback on the effectiveness of the vibration in removing the duct. To prevent excessive vibrations from transferring to the object being cleaned, a damping system might be included. This could be a rubber or foam padding between the device and the object. The vibrating device is securely attached to the filter with clamps, suction cups, magnets, or other fastening mechanisms. Alternatively, the vibration unit can be attached to a vibration unit actuator which moves the vibration generator to a specific location in proximity to the filter and a fastening mechanism implemented in the actuator fastens the vibration device to the filter when the actuator is activated by the control unit. In this case, when vibration of the filter is completed, the actuator retracts the vibration unit and stores it into its storage location in the housing.

In yet another aspect of the invention, a brush is used to loosen the dust particles for the fans to extract them easily. The brush is attached to a brush actuator. The control unit commands the brush actuator to slide the brush across the filter to loosen the dust particles. When the brushing is completed the control unit commands the brush actuator to retract the brush and to store it in its storage location inside the housing.

In yet another aspect of the invention, one or more UV light sources are used to kill biological debris such as bacteria and virus deposited on the filter. The UV light sources can optionally be attached to one or more UV source actuators. The control unit commands the UV actuators to position the UV sources in front and in proximity of the filter and to turn on the UV sources for a duration of time. The control unit then commands the UV source to turn off and to retract the UV sources into their resting locations in the housing.

In yet another aspect of the invention, a chemical spraying unit is used to kill biological debris such as bacteria and virus or to loosen the dust particles deposited on the filter. The chemical spraying unit can optionally be attached to a spraying unit actuator. The control unit commands the spraying unit actuator to position the spraying unit in front of the filter and in proximity of the filter and to turn on the spraying unit to spray chemicals on the filter for a duration of time. The control unit then commands the spraying unit to turn off and to retract it into its storage location in the housing.

DETAILED DESCRIPTION

Figure 1:
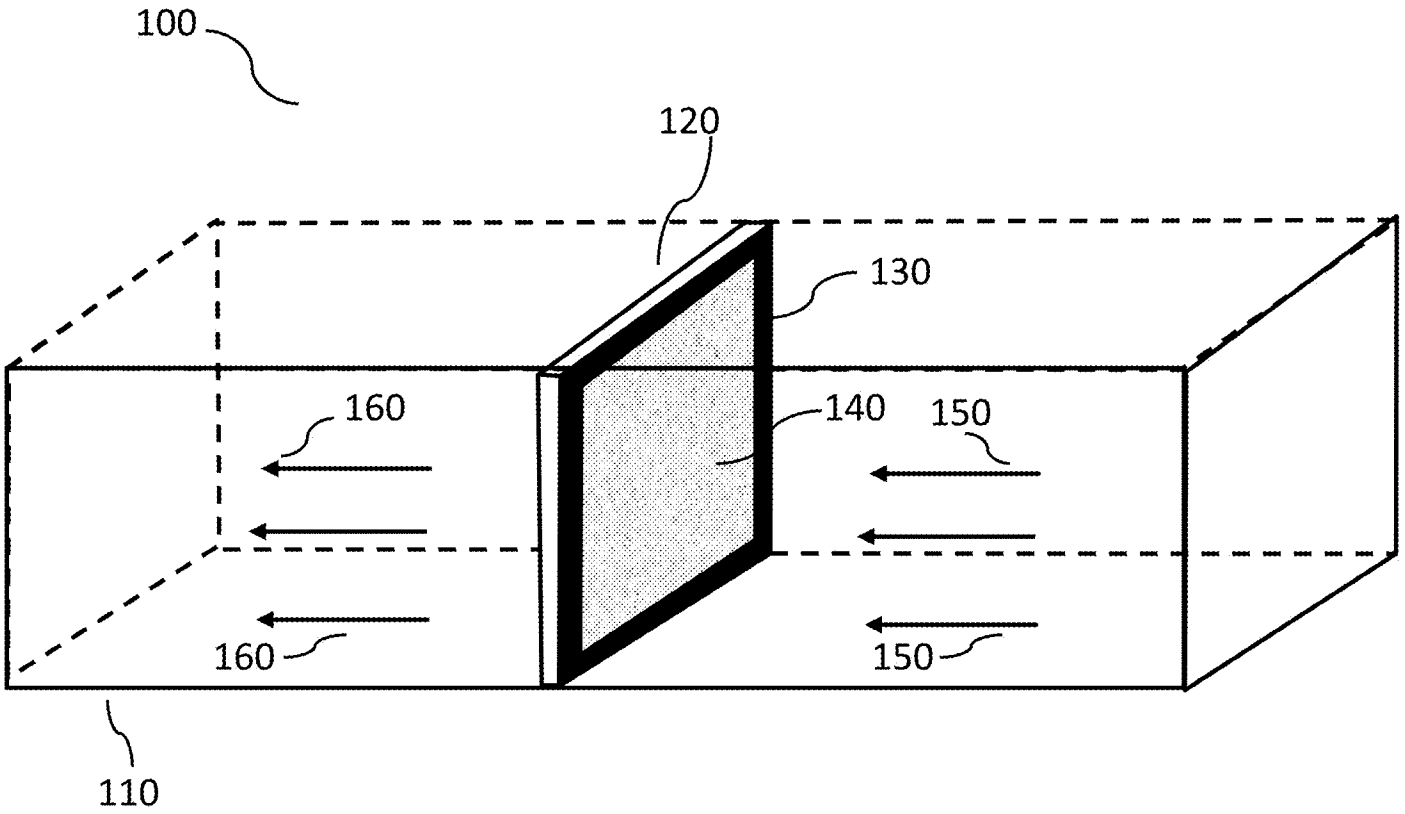
Figure 1 (PRIOR ART)
FIG. 1 depicts a schematic diagram of the salient components of an air handling unit including an air filter.

FIG. 1 depicts the salient components of an air handling unit 100. Air filter 120 is installed in air duct 110. Air filter 120 comprises a frame 130 to which a filter membrane 140 is attached. The filter membrane is a semi-permeable medium made from a variety of materials including paper, cotton fabric, and synthetic fiber. A motorized fan (not shown) causes outside air to flow as an incoming air stream 150 into duct 110. Air from the incoming flow 150 passes through filter 120 and flows out as outgoing air stream 160. Dust and other particulates in the incoming stream 150 are captured by air filter 120 and cleaner air goes out into the outgoing stream 160. Over a period of time as more air passes through air filter 120 more particulates are deposited into air filter 120 and more the filter is blocked rendering the filter less effective.

Figure 2:
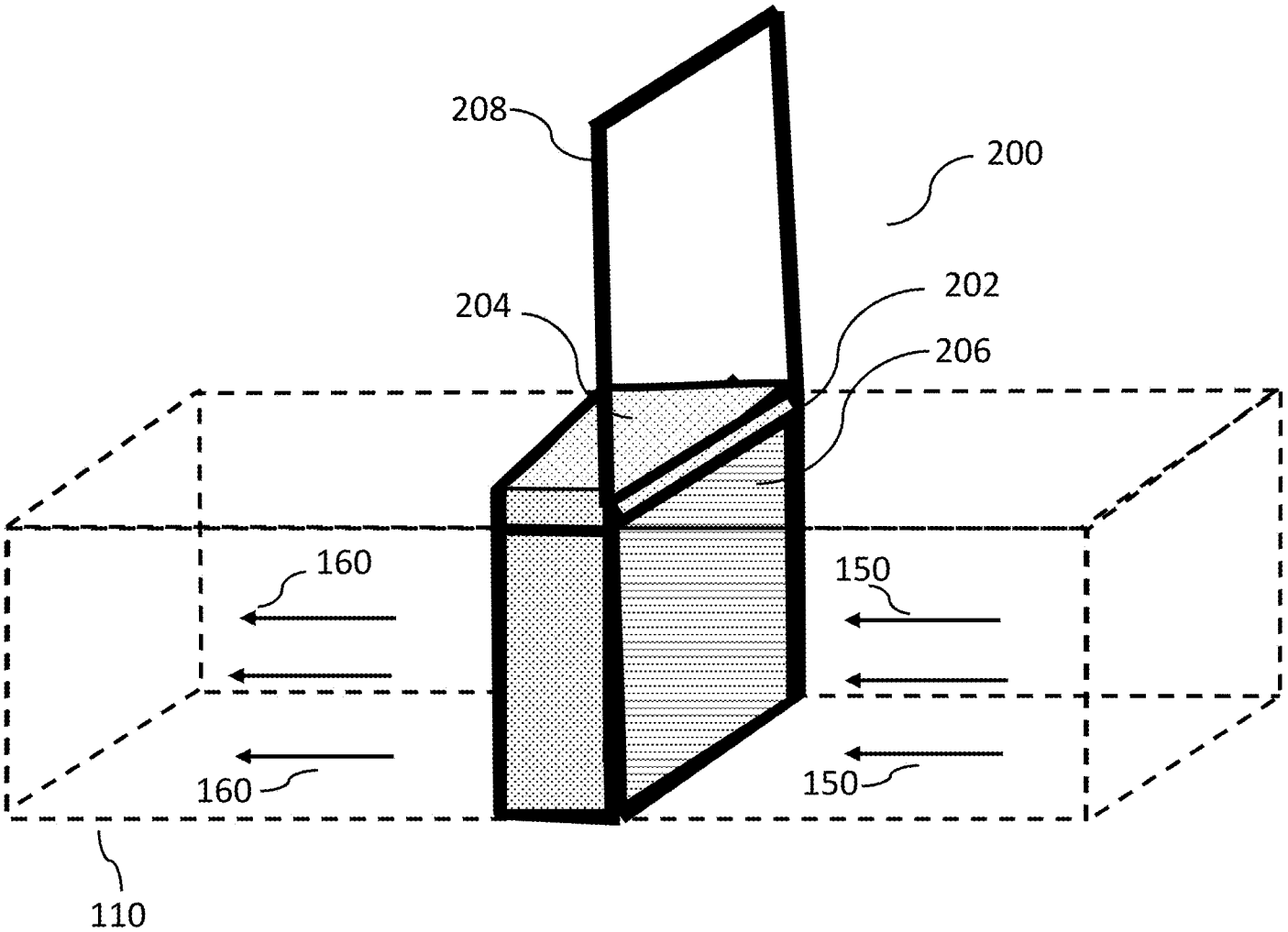
FIG. 2 depicts a schematic diagram of a filter regeneration system in accordance with the current invention when a filter regeneration system door is closed.

FIG. 2 depicts a schematic diagram of a filter regeneration system generally designated as 200 in accordance with a first embodiment of the current invention. Filter regeneration system 200 is mounted on air duct 110. Filter regeneration system 200 comprises a filter regeneration subsystem 202, a housing 204, a movable door 206 when it is in a closed position, and a door frame 208. When door 206 is in the closed position, door 206 blocks air stream 150 from getting into filter regeneration system 200. Housing 204 comprises an upper compartment and a lower compartment. Subsystem 202 is placed in the upper compartment of housing 204. The upper compartment has a lid on the top where a vent (not shown) is provided for air to be suctioned off from inside the lower compartment of housing 204 to another vent taking dirty air outside the building. Alternatively, a dust bag is installed in the upper compartment of housing 204 where dust collected from a dirty filter can be stored and the dust bag can be removed periodically when it is full. The upper compartment includes an opening at the lower surface of the upper compartment through which dust from filter 120 is collected in the dust bag or vented outside when filter 120 is regenerated. Housing 204 includes gaskets or lining made of rubber or similar material, so the lower compartment is substantially airtight when door 206 is closed for regeneration of filter 120.

Figure 3:
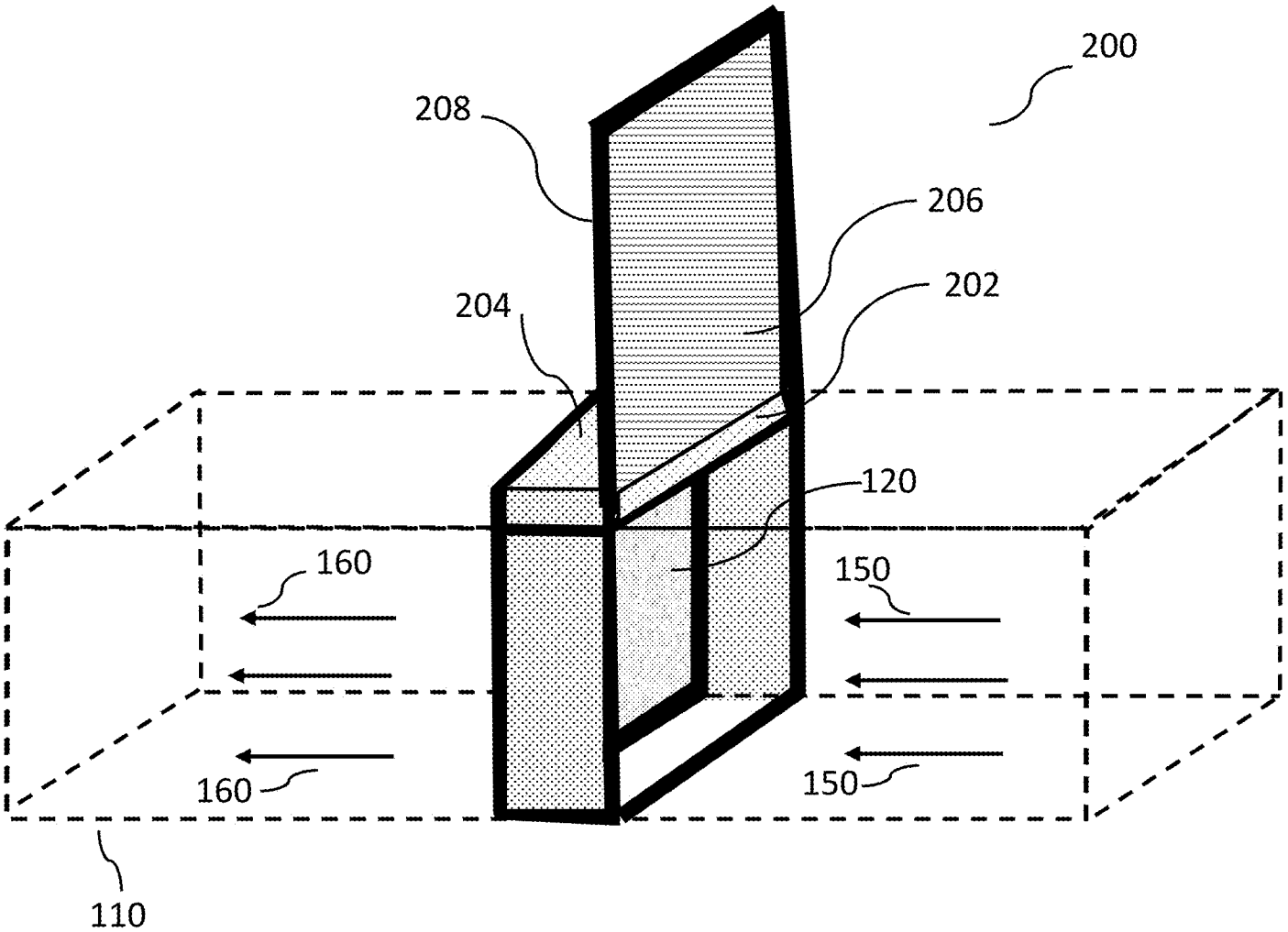
FIG. 3 depicts a schematic diagram of a filter regeneration system in accordance with the current invention when a filter regeneration system door is open.

FIG. 3 depicts a schematic diagram of filter regeneration system 200 when movable door 206 is moved in an open-door position by filter regeneration subsystem 202. Filter regeneration system 200 is mounted on air duct 110 in such a way that air stream 150 passes through filter 120 unobstructed by filter regeneration system 200 and does not leak through filter regeneration system 200.

Figure 4:
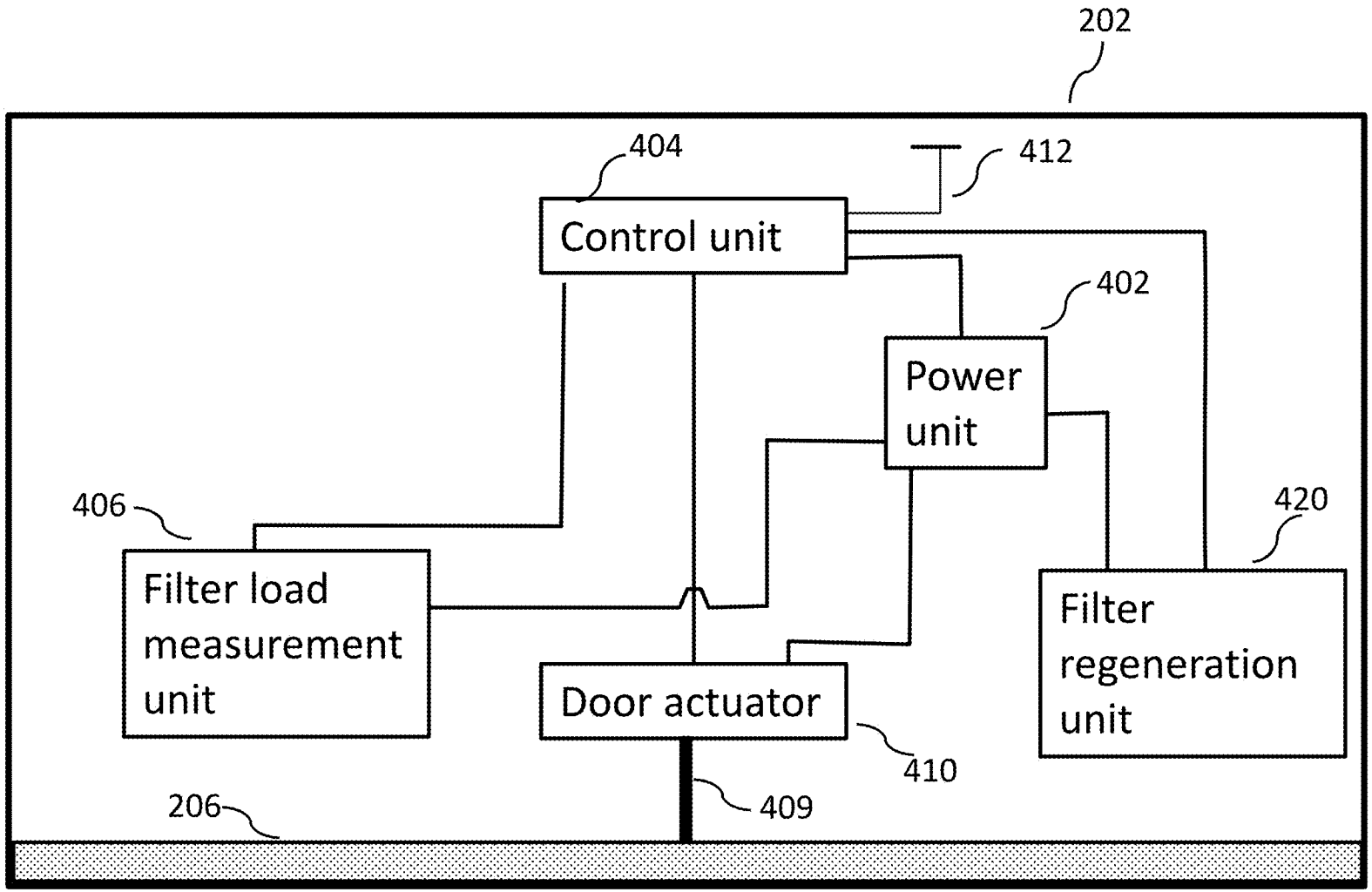
FIG. 4 depicts a schematic diagram of the salient components of a filter regeneration system in accordance with an embodiment of the current invention.

FIG. 4 depicts a schematic diagram of the salient components of filter regeneration subsystem 202. Subsystem 202 comprises an electric power supply unit 402, a control unit 404, a filter load measurement unit 406, a door actuator 410, an actuator arm 409, an antenna 412, and a filter regeneration unit 420. Control unit 404 comprises a central processing unit (CPU) or a microcontroller unit (MCU), a memory unit, a door actuator controller, a filter regeneration unit controller, and a filter load measurement unit controller. The memory unit is coupled with the processing unit via data lines. The memory unit can also be an integral part of the processing unit. A software or a firmware program is stored in the memory unit. The processing unit is coupled with the door controller, the filter regeneration controller and the filter load measurement unit controller via control data lines. Control unit 404 is coupled with antenna 412 to receive and send wireless communication data.

Control unit 404 activates filter load measurement unit to periodically measure the dust load on filter 120 triggered by a filter load measurement unit activation signal received by control unit 404 via antenna 412 or by a software program stored in control unit 404. Dust load data measured by filter load measurement unit 406 is received by control unit 404 and stored in the memory or sent to an outside cloud server via antenna 412. A predetermined dust load level parameter value is stored in control unit 404. During the periodic measurement events when the measured dust level parameter value reaches or exceeds the stored dust level parameter value, control unit 404 activates door actuator 410 to slide door 206 from its normal operation state of being open in door frame 208 to close door 206 so air from outside and fair rom air stream 150 cannot enter filter regeneration system 200. The status of door 206 being closed is maintained during the regeneration operation of filter 120. Upon door 206 having been closed, control unit 404 activates filter regeneration unit 420 to regenerate filter 120. Upon completion of regeneration of filter 120, control unit 404 deactivates filter regeneration unit and controls door actuator 410 to retract door 206 outside into its frame 208. In the open-door state, air duct system 110 is open, air from air stream 150 passes through filter 120 and the air handling system operates normally with unobstructed air flow.

Figure 5:
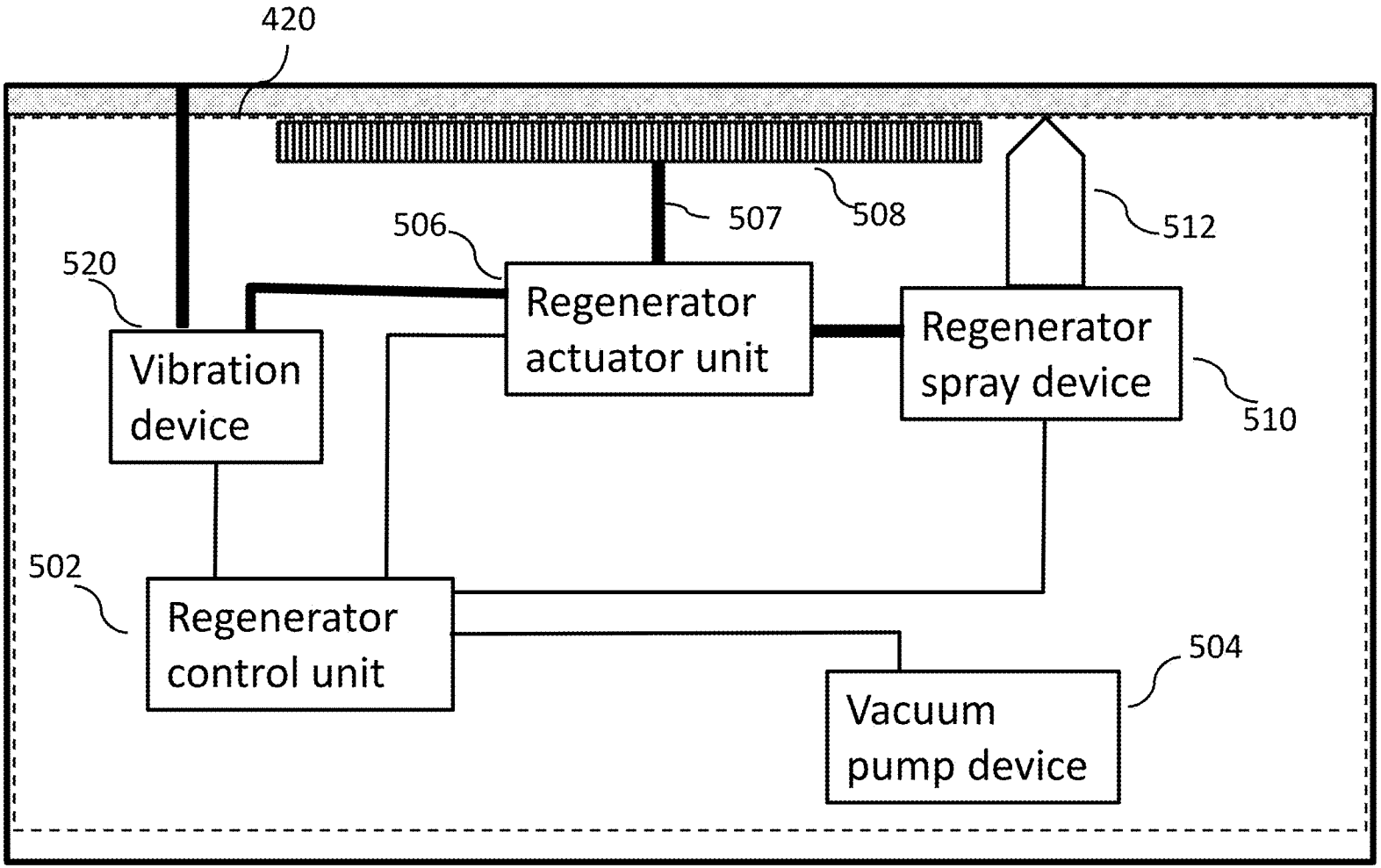
FIG. 5 depicts a schematic diagram of the salient components of a filter regeneration unit of the filter regeneration system in accordance with the current invention.

FIG. 5 depicts a schematic diagram of the salient components of filter regeneration subsystem 420. Subsystem 420 comprises a regenerator control unit 502, a vacuum pump device 504, a regenerator actuator unit 506, an actuator arm 507, a brush 508, a regenerator spray device 510, and a vibration device 520. Regenerator spray device 510 is capable of spraying a powdered solid, liquid or gaseous chemical agent onto the surface of filter 120. Regenerator spray device 510 may include a pump controlled by regenerator control unit 502 to spray a cleaning agent on the surface of filter 120. Vibration device 520 is a piezoelectric device, an unbalanced motor or any other type of vibration generating device. Vibration device 520 vibrates filter 120 when regeneration subsystem 420 is activated to regenerate filter 120. Regenerator actuator unit 506 is coupled with brush 508 via actuator arm 507. When regeneration subsystem is activated to remove dust from filter 120, regenerator actuator unit moves brush 508 across the dirty surface of filter 120. Vacuum pump device 504 is activated to suction off air and to create vacuum so dust particles from filter 120 is suctioned off filter 120 and is collected in a dust bag in vacuum pump device 504 or in regeneration system 200. Dust particles can be alternatively suctioned off and removed to outside air through a vent (not shown) included in regeneration system 200. Vibration device vibrating filter 120 as well as brush 508 brushing dust off of filter 120 while vacuum pump device 504 is in operation facilitates dust particles to be dislodged from filter 120 and to be suctioned off by vacuum pump device 504.

Figure 6:
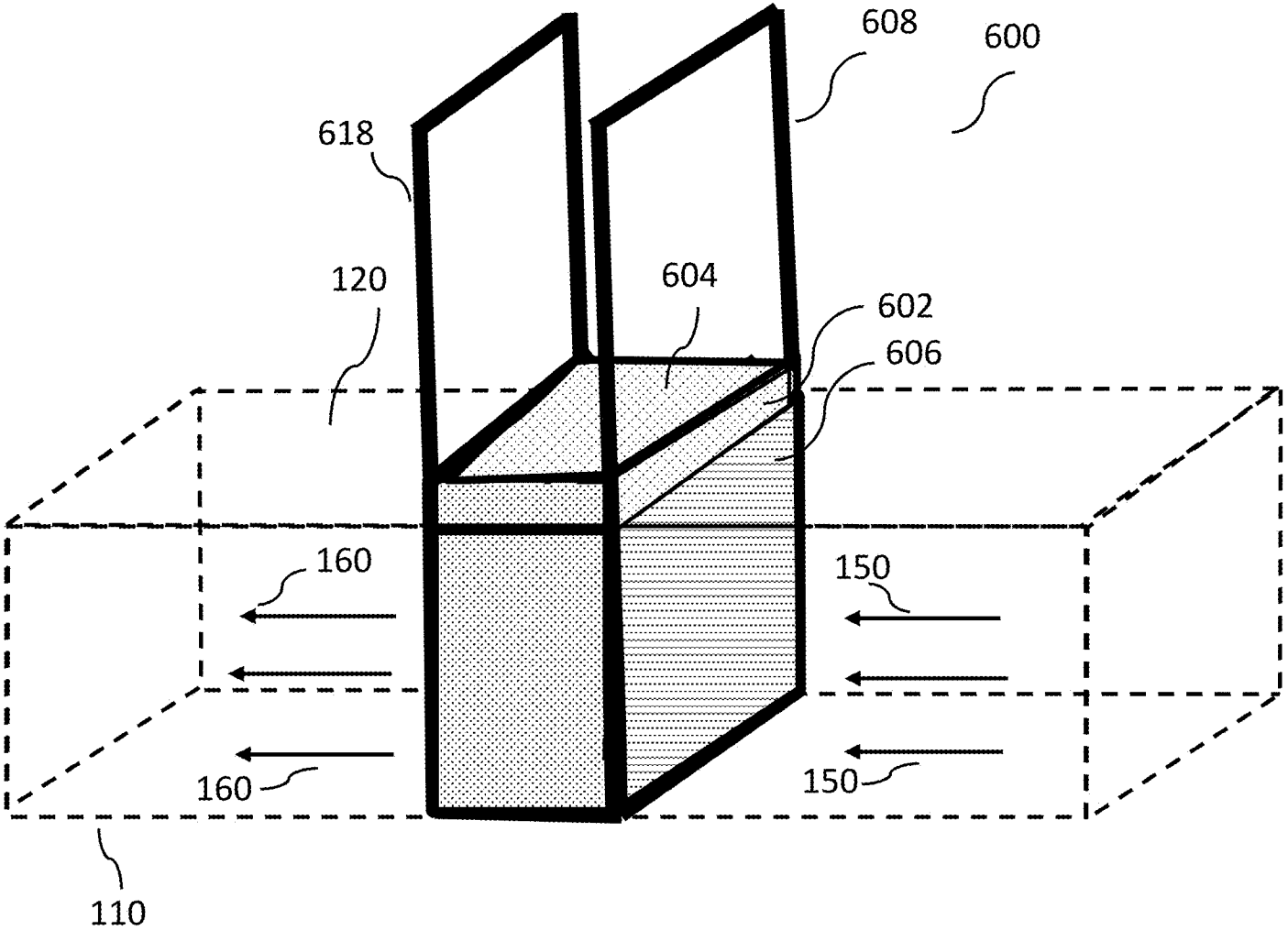
FIG. 6 depicts a schematic diagram of a filter regeneration system in accordance with a second embodiment of the current invention when two filter regeneration system doors are closed.

FIG. 6 depicts a schematic diagram of a filter regeneration system generally designated as 600 in accordance with a second embodiment of the current invention. Filter regeneration system 600 is mounted on air duct 110. Filter regeneration system 600 comprises a filter regeneration subsystem 602, a housing 604, a first movable door 606 when it is in a closed position, a second movable door 616 (behind door 606 and hidden in FIG. 6), a first door frame 608, and a second door frame 618. When door 606 and door 616 are in closed positions, doors 606 and 616 block air from getting into filter regeneration system 600. Housing 604 comprises an upper compartment and a lower compartment. Subsystem 602 is placed in the upper compartment of housing 604. The upper compartment has a lid on the top where a vent (not shown) is provided for air to be suctioned off from inside the lower compartment of housing 604 to another vent taking dirty air outside the building. Alternatively, a dust bag is installed in the upper compartment of housing 604 where dust collected from a dirty filter can be stored and the dust bag can be removed periodically when it is full. The upper compartment includes an opening at the lower surface of the upper compartment through which dust from filter 120 is collected in the dust bag or vented outside when filter 120 is regenerated. Housing 604 includes gaskets or lining made of rubber or similar material, so the lower compartment is substantially airtight when door 206 is closed for regeneration of filter 120.

Regeneration subsystem 602 is placed in the upper compartment of housing 602. The upper compartment has a lid on the top where a vent (not shown) is provided for air to be suctioned off from air duct 110 to another vent taking dirty air outside the building. Alternatively, a dust bag is installed in the upper compartment where dust collected from a dirty filter can be stored and the dust bag can be removed periodically when it is full. The upper compartment includes an opening through which dust from filter 120 is collected in the dust bag or vented outside when filter 120 is regenerated. The frame of filter regeneration system can include gaskets or lining made of rubber or similar material so the lower compartment is substantially airtight when door 608 and door 618 are closed for regeneration of filter 120.

Figure 7:
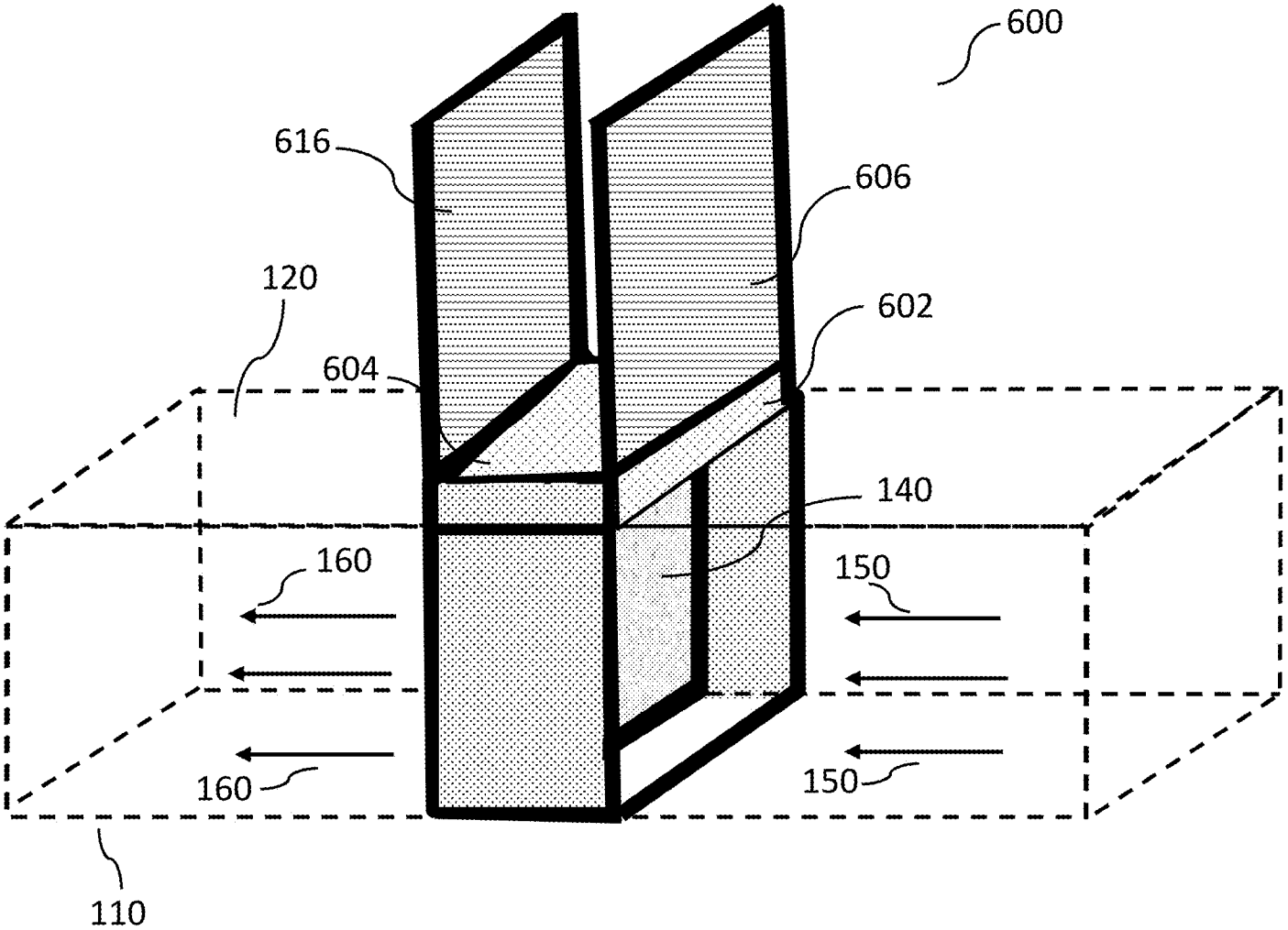
FIG. 7 depicts a schematic diagram of a filter regeneration system in accordance with the second embodiment of the current invention when two filter regeneration system doors are open.

FIG. 7 depicts a schematic diagram of filter regeneration system 600 when movable doors 606 and 616 are moved in an open-door position by filter regeneration subsystem 602. Filter regeneration system 600 is mounted on air duct 110 in such a way that air from stream 150 passes through filter 120 unobstructed and air does not leak through filter regeneration system 600.

Figure 8:
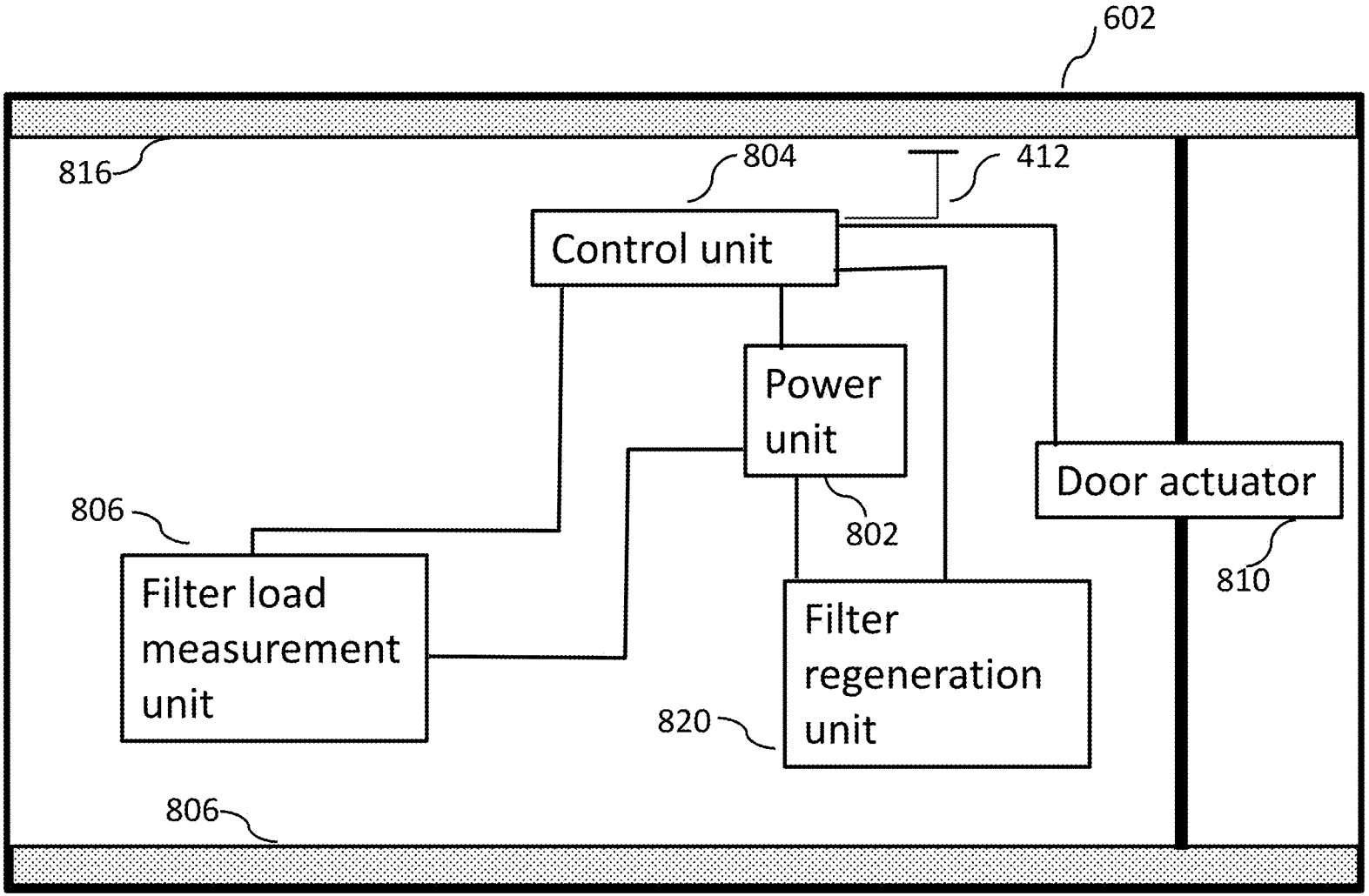
FIG. 8 depicts a schematic diagram of the salient components of a filter regeneration system in accordance with the second embodiment of the current invention.

FIG. 8 depicts a schematic diagram of the salient components of filter regeneration subsystem 602. Subsystem 602 comprises an electric power supply unit 802, a control unit 804, a filter load measurement unit 806, a door actuator 810, an antenna 412, and a filter regeneration unit 820. Control unit 804 comprises a central processing unit (CPU) or a microcontroller unit (MCU), a memory unit, a door actuator controller, a filter regeneration unit controller, and a filter load measurement unit controller. The memory unit is coupled with the processing unit via data lines. The memory unit can also be an integral part of the processing unit. A software or a firmware program is stored in the memory unit. The processing unit is coupled with the door controller, the filter regeneration controller and the filter load measurement unit controller via control data lines. Control unit 804 is coupled with antenna 412 to receive and send wireless communication data.

Control unit 804 activates filter load measurement unit 806 to measure the dust load on filter 120 triggered by a filter load measurement unit activation signal received by control unit 804 via antenna 412 or by a software program stored in control unit 804. Dust load data measured by filter load measurement unit 806 is received by control unit 804 and stored in the memory or sent to an outside cloud server via antenna 412. A predetermined dust load level parameter value is stored in control unit 804. During the periodic measurement events when the measured dust level parameter value reaches or exceeds the predetermined dust load level parameter value, control unit 804 activates door actuator 810 to slide doors 606 and 616 from their normal operation states of being open in door frames 608 and 618, respectively, to close door positions so air from outside or from air stream 150 cannot enter filter regeneration system 600. The status of doors 606 and 616 being closed is maintained during the regeneration operation of filter 120. Upon doors 606 and 616 having been closed, control unit 804 activates filter regeneration unit 820 to regenerate filter 120. Upon completion of regeneration of filter 120, control unit 804 deactivates filter regeneration unit 820 and controls door actuator 810 to retract doors 606 and 616 outside into their frames, 608 and 618, respectively. In this open door state, air duct system 110 is open when air from sir stream 150 passes through filter 120 and the air handling system operates normally with unobstructed air flow.

Figure 9:
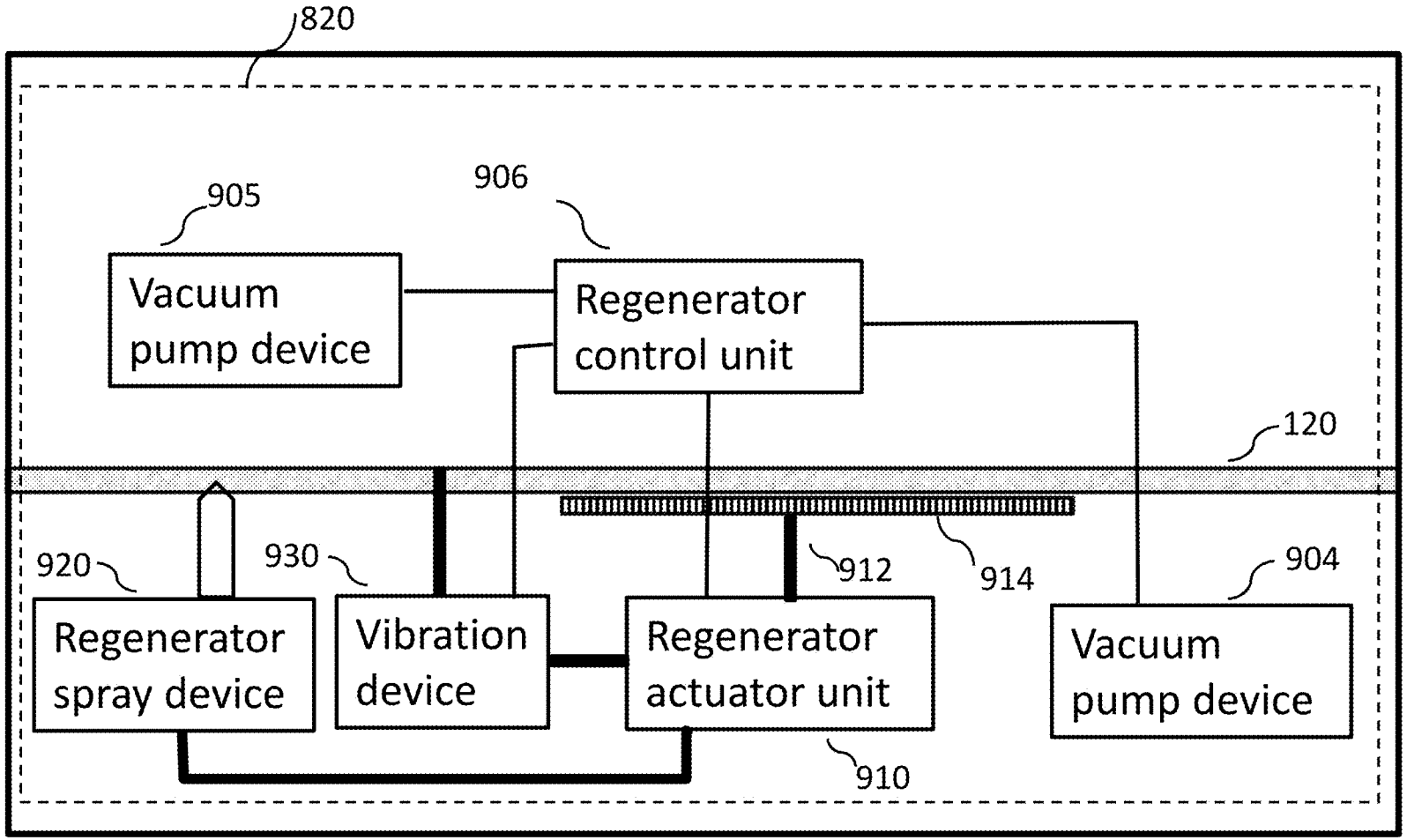
FIG. 9 depicts a schematic diagram of the salient components of a filter regeneration unit of the filter regeneration system in accordance with the second embodiment of the current invention.

FIG. 9 depicts a schematic diagram of the salient components of filter regeneration subsystem 820. Subsystem 820 comprises a regenerator control unit 902, a vacuum pump device 904, a fan unit 905, a regenerator control unit 906, a regenerator actuator unit 910, an actuator arm 912, a brush 914, a regenerator spray device 920, and a vibration device 930. Regenerator spray device 920 is capable of spraying a powdered solid, liquid or gaseous chemical agent onto the surface of filter 120. Regenerator spray device 920 may include a pump controlled by regenerator control unit 906 to spray a cleaning chemical agent on the surface of filter 120. Vibration device 930 is a piezoelectric device, an unbalanced motor or any other type of vibration generating device. Vibration device 930 vibrates filter 120 when regeneration subsystem 820 is activated to regenerate filter 120. Regenerator actuator unit 910 is coupled with brush 914 via actuator arm 912. When regeneration subsystem 820 is activated to remove dust from filter 120, regenerator actuator unit 910 moves brush 914 across the dirty surface of filter 120. Vacuum pump device 904 is activated to suction off air and to create vacuum so dust particles from filter 120 is suctioned off filter 120 and collected in a dust bag in vacuum pump device 904 or in a dust bag in regeneration system 800. Dust particles can be alternatively suctioned off and removed to outside air through a vent (not shown) included in regeneration system 800. Vibration device 930 vibrating filter 120 as well as brush 914 brushing dust off of filter 120 while vacuum pump device 904 is in operation facilitates dust particles to be dislodged from filter 120 and to be suctioned off by vacuum pump device 904. An air valve below each of vacuum pump unit and fan unit is provided. The valves are closed when regeneration subsystem 820 is inactive. When fan unit 905 and vacuum pump unit 904 are activated the air valves open up by air pressure providing air flow channel into duct 110 and out of duct 110, respectively. Fan unit 905 is placed in a location that is opposite to that of vacuum pump unit 904 with respect to filter 120. In other words, fan unit 905 blows air into the relatively cleaner side of filter 120 while vacuum pump unit suctions off air from the relatively dirtier side of filter 120. While regeneration subsystem 820 is active, regeneration control unit 906 also activates fan unit 905 to blow air at high pressure. High pressure air blowing into filter 120 by fan unit 905 while air is being suctioned off by vacuum pump device 904 from the opposite side of filter 120 further facilitates dislodging dust particles off of filter 120.

Figure 10:
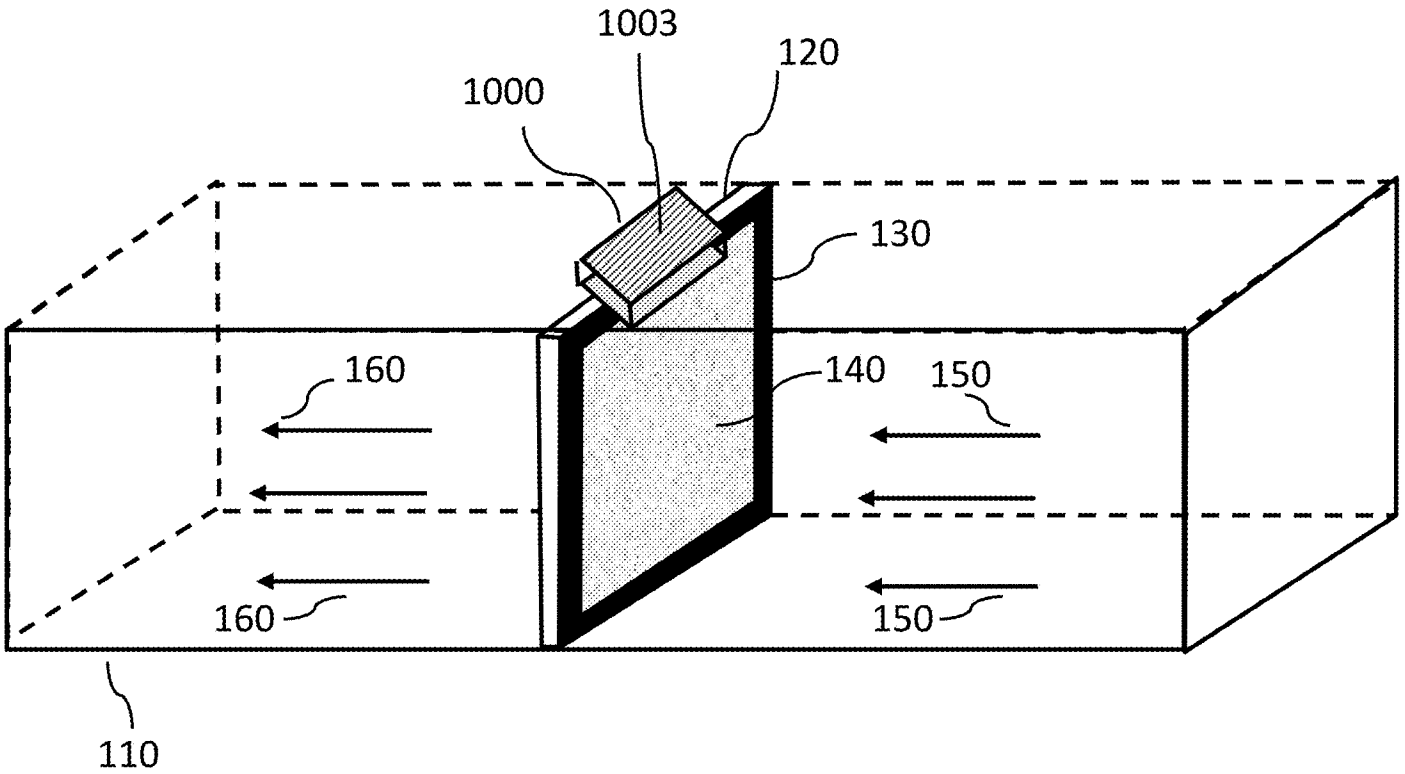
FIG. 10 depicts a schematic diagram of a filter regeneration system in accordance with a third embodiment of the current invention.

FIG. 10 depicts a schematic diagram of a filter regeneration system generally designated as 1000 in accordance with a third embodiment of the current invention. Filter regeneration system 1000 is mounted on the outside of a wall of air duct 110 as shown in FIG. 1. Alternatively, filter regeneration system 1000 is mounted on the inside of a wall of air duct 110 (not shown in FIG. 1). Filter regeneration system 1000 comprises a filter regeneration subsystem 1002 (hidden inside) and a housing 1003. Housing 1003 comprises a lid on the top which can be opened to access subsystem 1002. An opening is provided at the top of housing 1003 for a vent to be attached for dusty air to be suctioned off of filter 120 when filter 120 is being regenerated. Alternatively, a dust bag is provided inside housing 1003 for dust to be collected in the bag when filter 120 is being regenerated. When regeneration system 1000 is mounted inside duct 110 an opening is provided through duct 110 and regeneration system 1000 so dusty air to be removed off of filter 120 when filter 120 is being regenerated to outside via a vent attached to the opening.

Figure 11:
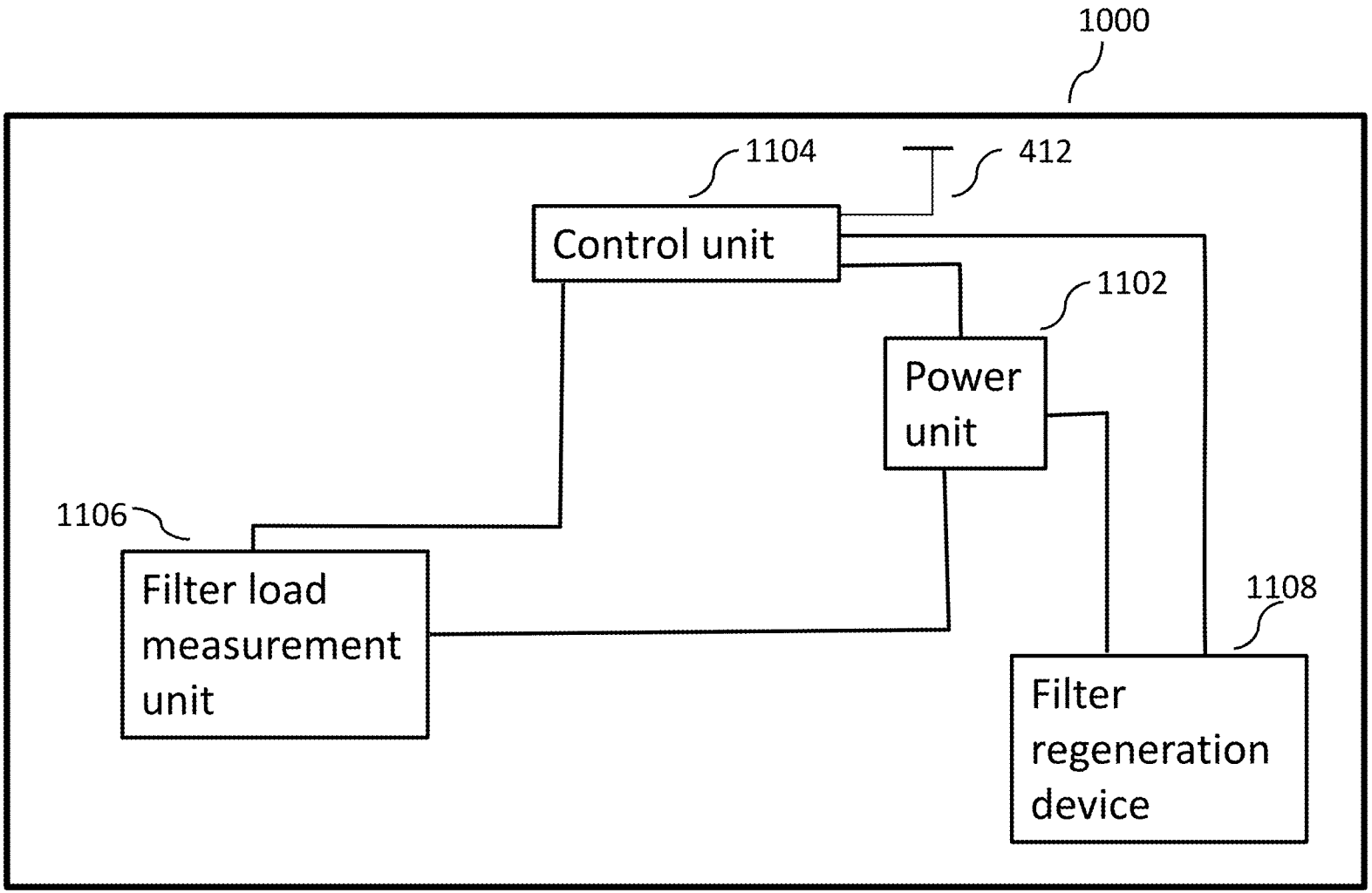
FIG. 11 depicts a schematic diagram of the salient components of a filter regeneration system in accordance with the third embodiment of the current invention.

FIG. 11 depicts a schematic diagram of the salient components of filter regeneration subsystem 1002. Subsystem 1002 comprises an electric power supply unit 1102, a control unit 1104, a filter load measurement unit 1106, and a filter regeneration device 1108. Control unit 1104 comprises a central processing unit (CPU) or a microcontroller unit (MCU), and a memory unit. The memory unit is coupled with the processing unit via data lines. The memory unit can also be an integral part of the processing unit. A software or a firmware program is stored in the memory unit. The processing unit is coupled with filter regeneration device 1108 and the load measurement unit 1106 via control data lines. Control unit 1104 is coupled with antenna 412 to receive and send wireless communication data.

Control unit 1104 activates filter load measurement unit 1106 to measure the dust load on filter 120 triggered by a filter load measurement unit activation signal received by control unit 1104 via antenna 412 or by a software program stored in control unit 1104. Dust load data measured by filter load measurement unit 1106 is received by control unit 1104 and stored in the memory or sent to an outside cloud server via antenna 412. A predetermined dust load parameter value is stored in control unit 1104. If the measured dust load parameter value reaches or exceeds the predetermined dust parameter value during the periodic measurement events triggered by stored program in control unit 1104, control unit 1104 activates filter regeneration device 1108.

Figure 12:
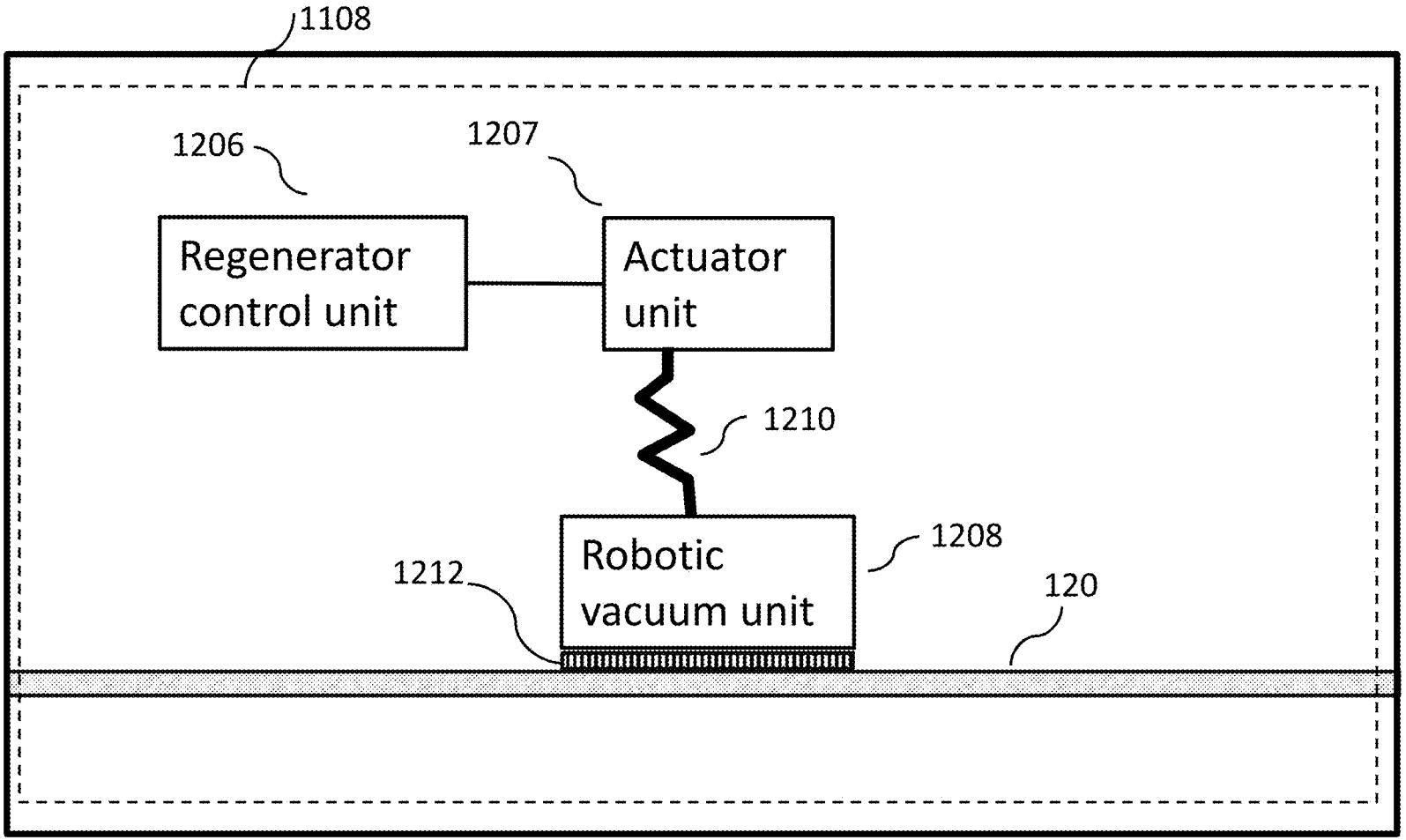
FIG. 12 depicts a schematic diagram of the salient components of a filter regeneration unit of the filter regeneration system in accordance with the third embodiment of the current invention.

FIG. 12 depicts a schematic diagram of the salient components of filter regeneration device 1108. Filter regeneration device 1108 is a robotic vacuum cleaning device comprising a regenerator control unit 1206, an actuator unit 1207, a vacuum pump device 1208, and a robotic arm 1210. Regenerator control unit 1206 can be integrated into control unit 1104. Regenerator control unit 1206 when activated by control unit 1104, activates actuator unit 1207 to move robotic vacuum unit 1208 across the entire surface of filter 120 while using air suction to vacuum off dust deposited on filter 120. Robotic vacuum unit comprises a vacuum pump (not shown), a brush 1212, and one or more sensors (not shown). Brush 1212 allows robotic vacuum unit 1208 to crawl smoothly on the uneven surface of filter 120 while efficiently vacuuming off dust off of filter 120. The one or more sensors sense the edges of filter 120 and the sensor data are used to redirect vacuum cleaning unit in another direction on the surface of filter 120. A software program stored in regenerator control unit 1206 or in robotic vacuum unit 1208 uses the sensor data and/or the knowledge of filter dimensions to direct robotic vacuum unit 1208 to vacuum the entire surface of filter 120. When regenerator control unit 1206 or robotic vacuum unit 1208 determines that the entire surface of filter 120 has been vacuumed, regenerator control unit directs actuator 1207 to retract robotic vacuum unit 1208. Being so directed, actuator 1207 retracts robotic vacuum unit 1208 into housing 1003 by actuating robotic arm 1210. Robotic actuator arm is also retracted into housing 1003.

In an alternative embodiment of the robotic vacuum unit 1208, filter 120 is mounted on a frame that is actuated by an actuator to be tilted so that filter 120 is in a horizontal position. In this embodiment, robotic vacuum unit 1208 crawls on the surface of the horizontally oriented filter 120 and vacuum cleans the filter surface. Robotic vacuum unit 1208 can be self-controlled guided by the sensors incorporated in vacuum unit 1208. When cleaning the entire filter surface is completed, vacuum unit 1208 is retracted in the housing of apparatus 100 and the filter is returned to its normal which is typically vertical orientation. If the normal orientation of filter 120 is horizontal, then the filter frame does not need to be actuated for tilting and vacuum unit 1208 can come out of housing 1003 to clean the horizontally oriented filter 120 without a need for actuator unit 1207 for being controlled for movement of robotic vacuum unit 1208.

Figure 13:
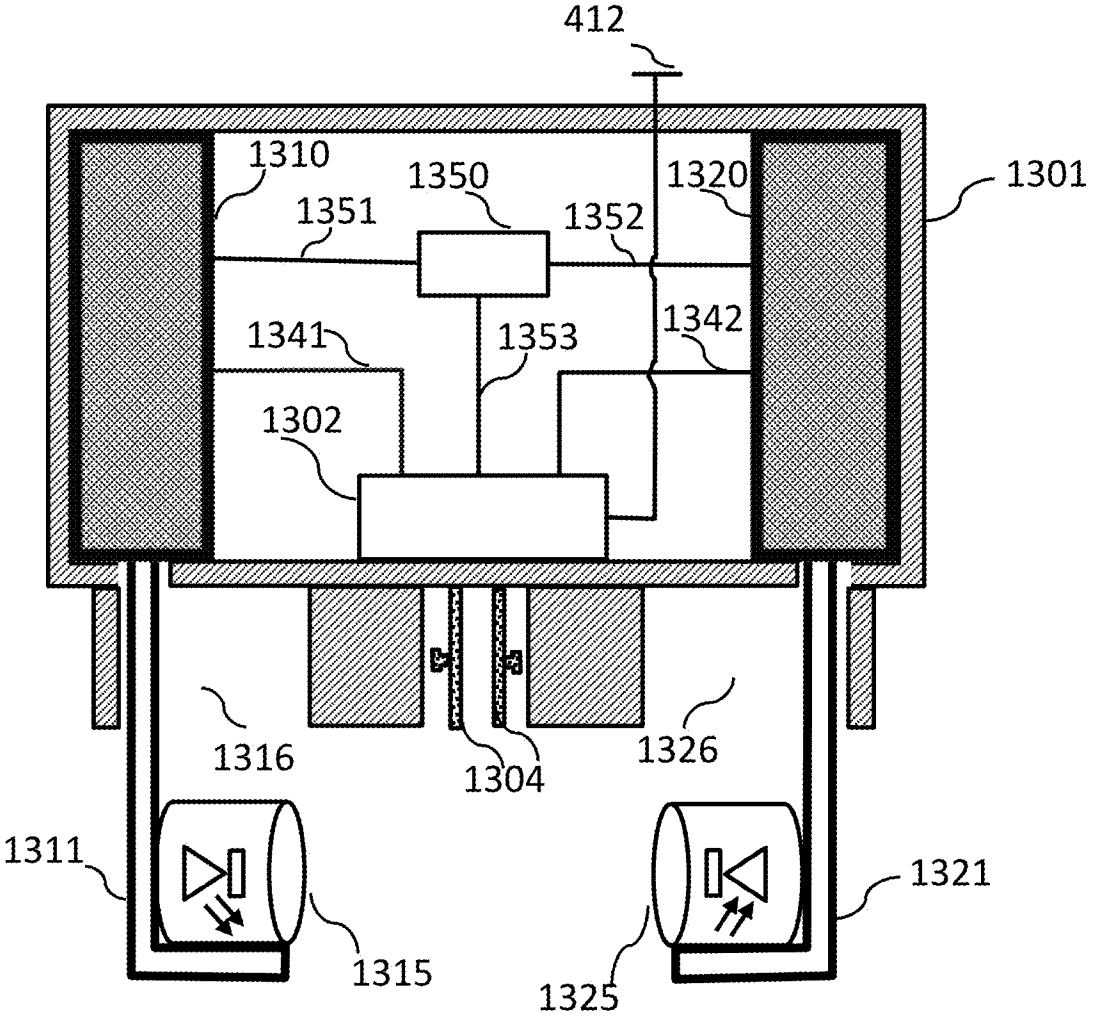
FIG. 13 depicts a schematic diagram of the salient components of an exemplary filter load-measurement unit.

FIG. 13 depicts a schematic diagram of the salient components of filter load measurement unit 1106. Filter load measurement unit 1106 comprises a housing 1301, a control device 1302, a mounting device 1304, two actuators 1310 and 1320, two actuator arms 1311 and 1321, a light source device 1315, a light sensor device 1325, an electric power source 1350, and an antenna 412. Mounting device 1302 can be a clip or a bracket for mounting the system 200 onto the frame 130 of the filter 120. Control device 1340 is coupled with actuators 1310 and 1320 via the control links 1341 and 1342, respectively. Light source device 1315 is attached at the end of actuator arm 1311. Light sensor device 1325 is attached at the end of actuator arm 1321. Power source 1350 is a battery. Alternatively, power source 1350 is a power unit coupled with an external power source such as a vehicle battery, an air circulation system power unit, or a grid power wall socket, from which power is drawn by power source 1350. Power source 1350 provides electric power to the actuators 1310 and 1320 via the wirings 1351 and 1352, respectively, and to control device 1302 via wiring 1353.

Actuators 1310 and 1320 activated by control device 1302 extends actuator arms 1311 and 1321 to place light source 1315 and light sensor 1325, respectively, on two sides of filter 120. Responsive to a control signal received from control device 1302, light source device 1315 is turned on and sensor device is activated to measure light intensity passing through filter 120. Control device 1302 directs actuators 1310 and 1320 to place light source 1315 and light sensor 1325 on opposite sides of filter 120 at multiple locations of filter 120 and to measure light intensity at the multiple locations of filter 120. Control device 1302 determines accumulated dust load on filter 120 from the measured intensity data at the multiple locations of filter 120.

Filter load measurement unit 1106 in an alternative embodiment is a timer. The elapsed time measured by the timer since the installation of filter 120 in duct 110 is a measure of the filter dust load.

Filter load measurement unit 1106 in yet another alternative embodiment is a differential pressure sensor which measures air pressure on two sides of filter 120. The difference in the values of the air pressure between two sides of filter 120 of filter is a measure of the filter dust load.

Antenna 412 is coupled with control unit 1302 and a wireless network (not shown). Control unit 1302 communicates with external devices and systems via antenna 412 and the wireless network to send and receive pertinent data from external server computer and mobile devices.

Figure 14:
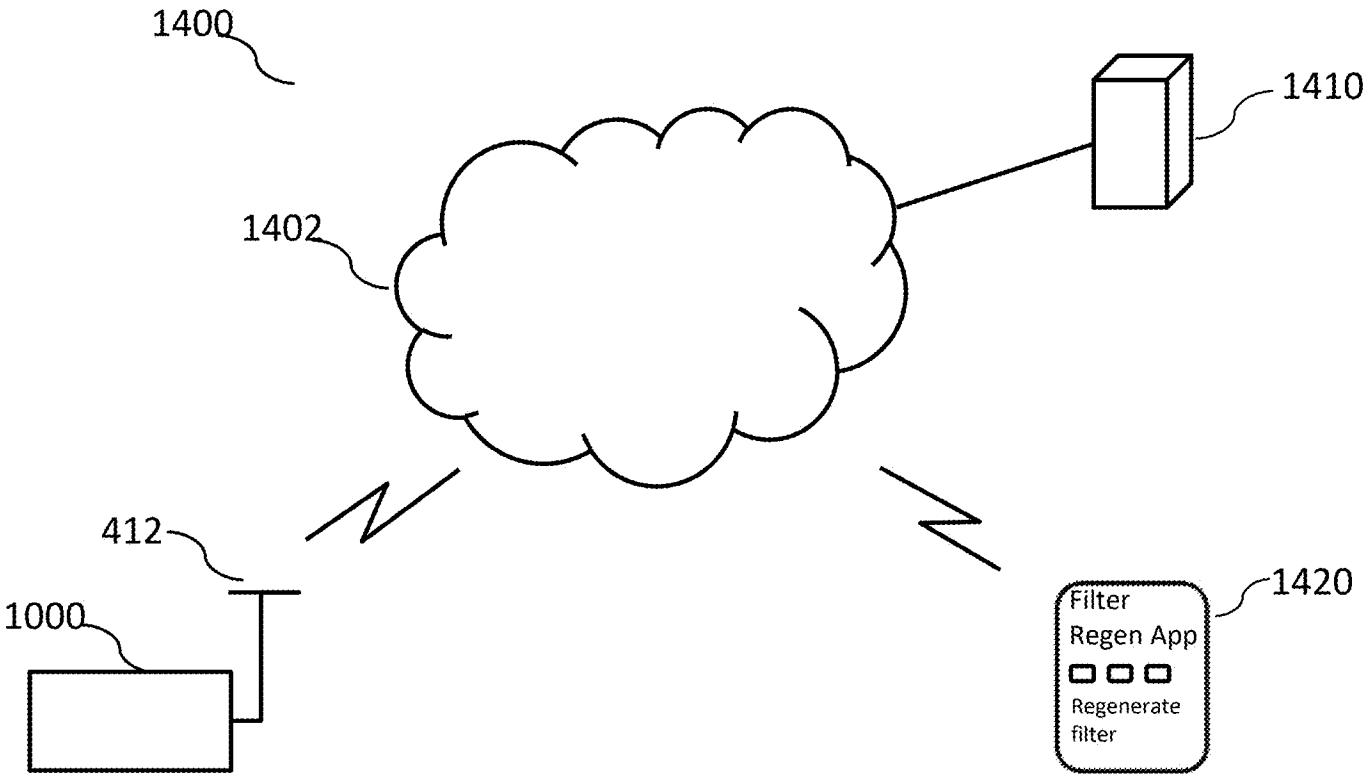
FIG. 14 depicts a schematic diagram of the salient components of a communication system in accordance with the current invention.

FIG. 14 depicts a schematic diagram of the salient components of a communication system 1400 in accordance with the current invention. Communication system 1400 comprises filter regeneration system 1000, a wireless network 1402, a server computer 1410, and a user device 1420. Antenna 412, server computer 1410 and user device 1420 are coupled via network 1402. Typically, server computer 1410 is coupled with network 1402 via wired connection such as fiber optics links. User device 1420 is typically a mobile phone coupled with wireless network 1402 via radio links. Filter regeneration system 1000 is typically coupled with wireless network 1402 via radio links between antenna 412 and one or more base station antennae in wireless network 1402. Wireless network 1402 is a WiFi network, a wireless network or a combination of wired, WiFi and wireless cellular networks.

Communication system 1400 advantageously uses the IoT capabilities of wireless network 1402. The IoT capabilities are based on technology standards defined by International Telecommunication Union (ITU) and 3GPP ($3^{rd}$ Generation Partnership Project—a telecommunications industry consortium). Devices and networks compliant with IoT standards specifications such as 3GPP TR 36.752 and ITU-T Y-2060 have several advantages. For example, the communication protocols and bandwidth requirements are defined specifically for efficient usage by a significantly greater number of IoT devices for shorter bursts of communications compared to the requirements for human to human or human to machine communications. Because standards-based devices are used worldwide the components required to implement IoT features in devices are cheaper. The IoT capability provides the necessary infrastructure including communication protocols, security, device and network management, bandwidth specifications, etc. for device-to-device in other words among things communications. Thus, it is advantageous for communication system 1400 to utilize the IoT capabilities for short and bursty communications with computer server 1410 and user device 1420.

User device 1420 includes an application program for communication with filter regeneration system 1000. When an alert message is received from filter regeneration system 1000 directly or from the server 1410, the application program is activated, and an appropriate alert is displayed on the user interface of the application program in user device 1420. In addition to receiving alert messages, the user can send a filter status enquiry to filter regeneration system 1000 or to server 1410. In response to the enquiry filter regeneration system 1000 or server 1410 sends the current filter status information for display on the user interface on the screen of user device 1420. Furthermore, the user can send a new regeneration parameter threshold value to filter regeneration system 1000 or server computer 1410 and filter regeneration system 1000 or server computer 1410 stores the new threshold value in the memory. The alert message can also be in the form of a text message to user device 1420.

Filter regeneration system 1000 set up can be easily accomplished with the application program. For example, the user can download the application program from filter regeneration system manufacturer's website. The application program when opened asks the user to insert the device ID for filter regeneration device which is typically printed on the device as a bar code or a QR Code. The application program then automatically communicates with the server to set up the user's account, to register and to activate system 1000.

Certain features are of utility and may be employed in the filter regeneration system of the invention. For example, filter regeneration system 1000 can include a GPS chip. Based on the GPS data and the frequency of regeneration data from a large number of filters in a particular area the server can determine the degree of air quality in a specific area. In another example, if load measurement unit measures a load above the load threshold value even after regeneration has been completed, an alert message is created and sent to user device 1420 to indicate filter 120 cannot be regenerated anymore and hence should be replaced.

It is to be understood that the above-described embodiments are merely illustrative of the present invention and that many variations of the above-described embodiments can be devised by those skilled in the art without departing from the scope of the invention. For example, in this Specification, numerous specific details are provided in order to provide a thorough description and understanding of the illustrative embodiments of the present invention. Those skilled in the art will recognize, however, that the invention can be practiced without one or more of those details, or with other methods, materials, components, etc.

Furthermore, in some instances, well-known structures, materials, or operations are not shown or described in detail to avoid obscuring aspects of the illustrative embodiments. It is understood that the various embodiments shown in the Figures are illustrative and are not necessarily drawn to scale. Reference throughout the specification to "first embodiment" or "second embodiment" or "one embodiment" or "an embodiment" or "some embodiments" means that a particular feature, structure, material, or characteristic described in connection with the embodiment(s) is included in at least one embodiment of the present invention, but not necessarily all embodiments. Consequently, the appearances of the phrase "first embodiment," "second embodiment," "third embodiment," "in one embodiment," "in an embodiment," or "in some embodiments" in various places throughout the Specification are not necessarily all referring to the same embodiment. Furthermore, the particular features, structures, materials, or characteristics can be combined in any suitable manner in one or more embodiments. It is therefore intended that such variations be included within the scope of the following claims and their equivalents.

What is claimed is:

1. An apparatus for regenerating a filter comprising: a filter load measurement unit, a control unit, and a filter regeneration unit;

wherein the filter load measurement unit is configured to measures a first value of a quantity of dust load accumulated on the filter either at predetermined time intervals or responsive to a load measurement activation signal received from the control unit;

wherein the control unit compares the first value of the quantity of dust load with a predetermined first threshold value of the quantity of dust load;

wherein the control unit sends a regeneration activation signal to the filter regeneration unit based on the comparison;

wherein the filter regeneration unit initiates a regeneration process to regenerate at least a portion of the filter responsive to receiving the regeneration activation signal;

wherein the regeneration process occurs without removing the filter;

wherein the filter regeneration unit terminates the regeneration process responsive to either a regeneration termination signal received from the control unit or the expiration of a predetermined regeneration duration; and wherein the regeneration termination signal is sent when the quantity of dust load accumulated on the filter returns back to a value within a desired range.

2. The apparatus of claim 1 wherein the apparatus further comprising a first movable door, a door actuator, and a vacuum pump device;

wherein the control unit actuates the door actuator to move the first movable door in proximity to a first side of the filter in a closed position when the filter regeneration unit is activated by the control unit; and wherein the vacuum pump device suctions off air from a space between the first movable door in the closed position and the filter when the regeneration unit begins the regeneration process.

3. The apparatus of claim 2 wherein the apparatus further comprising a second movable door and a fan unit;

wherein the control unit actuates the door actuator to move the second movable door in proximity to a second side of the filter which is on the opposite side of the first side of the filter in a closed position when the filter regeneration unit is activated by the control unit; and wherein the fan unit blows air into a space between the second movable door in the closed position and the filter when the regeneration unit begins the regeneration process.

4. The apparatus of claim 1 wherein the apparatus further comprising an antenna, a cloud server and a user device;

wherein the filter load measurement unit measures a second value of the quantity of dust load after the termination of the regeneration process;

wherein the control unit compares the second value of the quantity of dust load with the predetermined threshold value of the quantity of dust load;

wherein the control unit generates a filter replacement alert signal if the second value of the quantity of dust load is higher than the predetermined threshold value of the quantity of dust load; and wherein the filter replacement alert signal is sent to the cloud server or to the user device via the antenna.

5. The apparatus of claim 2 wherein the regeneration unit comprising a regeneration actuator unit, and a brush;

wherein the control unit activates the regeneration actuator unit when the filter regeneration unit is activated by the control unit;

wherein the regeneration actuator unit having been activated moves the brush on a surface of the filter; and wherein the brush brushes the surface of the filter during the regeneration process while the vacuum pump device suctions off air from a space enclosed by the first movable door and the filter.

6. The apparatus of claim 2 wherein the regeneration unit comprising a regeneration actuator unit and a regenerator spray unit;

wherein the control unit activates the regeneration actuator unit when the filter regeneration unit is activated by the control unit;

wherein the regeneration actuator unit having been activated moves the spray unit in proximity to a surface of the filter; and wherein the spray unit having been moved in proximity to the surface of the filter is turned on to spray a cleaning agent on the surface of the filter.

7. The apparatus of claim 2 wherein the regeneration unit comprising a regeneration actuator unit and a UV light source;

Wherein the control unit activates the regeneration actuator unit when the filter regeneration unit is activated by the control unit;

wherein the regeneration actuator unit having been activated places the UV light source in proximity to a surface of the filter; and wherein the UV light source having been placed in proximity to the surface of the filter is turned on to shine UV light on the surface of the filter.

8. The apparatus of claim 2 wherein the regeneration unit comprising a regeneration actuator unit, and a vibration device;

wherein the control unit activates the regeneration actuator unit when the filter regeneration unit is activated by the control unit;

wherein the regeneration actuator unit having been activated actuates the vibration unit to vibrate the filter while the vacuum pump device suctions off air from a space enclosed by the first movable door and the filter.

9. The apparatus of claim 1 wherein the load measurement unit comprising a first pressure sensor device and a second pressure sensor device;

wherein the first pressure sensor device is placed in a first space in proximity to a first side of the filter and the second pressure sensor device is placed in a second space in a second space in proximity to a second side which is in the opposite side of the first side of the filter;

wherein the first pressure sensor device measures air pressure in the first space and the second pressure sensor device measures air pressure in the second space; and wherein the measured value of the quantity of dust load accumulated on the filter is determined based on the air pressure value measured by the first pressure sensor device and on the air pressure value measured by the second pressure sensor device.

10. The apparatus of claim 1 wherein the load measurement unit comprising: one or more actuators, a light source, and a light sensor;

wherein the one or more actuators place the light source and the light sensor on two opposite sides of the filter responsive to one or more actuation control signals received from the control unit;

wherein the light source and the light sensor are activated responsive to one or more light source and light sensor activation signals, respectively, received from the control unit; and wherein the light sensor device upon activation takes a measurement of the value of a quantity of light received by the light sensor;

wherein the quantity of light is a portion of the light generated by the light source and transmitted through the filter; and wherein the measured value of the quantity of dust load accumulated on the filter is determined based on the measured value of the quantity of light received by the light sensor.

11. The apparatus of claim 1 wherein the control unit generates the regeneration termination signal based on a second threshold value of the quantity of dust load; and wherein the second threshold value is within a desired range.

12. An apparatus for regenerating a filter comprising: a filter load measurement unit, a control unit, and a vacuum cleaning device;

wherein the filter load measurement unit is configured to measures a first value of a quantity of dust load accumulated on the filter either at predetermined time intervals or responsive to a load measurement activation signal received from the control unit;

wherein the control unit compares the first value of the quantity of dust load with a predetermined threshold value of the quantity of dust load;

wherein the control unit sends a regeneration activation signal to the vacuum cleaning device based on the comparison;

wherein the vacuum cleaning device initiates a regeneration process to regenerates at least a portion of the filter in response to receiving the regeneration activation signal;

wherein the regeneration process occurs without removing the filter;

wherein the vacuum cleaning device stops the regeneration process responsive to either a regeneration termination signal received from the control unit or the expiration of a predetermined regeneration duration; and wherein the regeneration termination signal is sent when the quantity of dust load accumulated on the filter returns back to a value within a desired range.

13. The apparatus of claim 12 wherein the apparatus further comprising an antenna, a cloud server and a user device;

wherein the filter load measurement unit measures a second value of the quantity of dust load after the termination of the regeneration process;

wherein the control unit compares the second value of the quantity of dust load with the predetermined threshold value of the quantity of dust load;

wherein the control unit generates a filter replacement alert signal based on the comparison; and wherein the filter replacement alert signal is sent to the cloud server or to the user device via the antenna.

14. The apparatus of claim 12 wherein the vacuum cleaning device comprising one or more sensors and a brush;

wherein the control unit controls the vacuum cleaning device to move the vacuum cleaning device in a first direction on or in proximity to a surface of the filter;

wherein the one or more sensors sense a presence of an obstructive object in a space surrounding the vacuum cleaning device;

wherein the vacuum cleaning device moves in a second direction on or in proximity to the surface of the filter at least partially based on the sensed presence of the obstructive object;

wherein the vacuum cleaning device having been moved to one or more locations on or in proximity to the surface of the filter during the regeneration process vacuum cleans the filter at the one or more locations on the surface of the filter; and wherein the brush brushes the filter at the one or more locations of the filter while being vacuum cleaned by the vacuum cleaning device.

15. The apparatus of claim 12 wherein the vacuum cleaning device further comprising a UV light source;

wherein the vacuum cleaning device turns on the UV light source to shine UV light on a surface of the filter during at least a portion of the regeneration process.

16. The apparatus of claim 12 further comprising a housing and one or more sensors;

wherein the vacuum cleaning device moves out of the housing and onto a surface of the filter in a first direction;

wherein the one or more sensors sense a presence of an obstructive object in a space surrounding the vacuum cleaning device;

wherein the vacuum cleaning device moves in a second direction on or in proximity to the surface of the filter based at least partially on the sensing of the presence of the obstructive object by the one or more sensors;

wherein the vacuum cleaning device vacuum cleans a portion of the filter while moving in the first direction or after moving in the first direction and while moving in the second direction or after moving in the second direction; and wherein the vacuum cleaning device moves into the housing when the vacuum cleaning device terminates the regeneration process.

17. The apparatus of claim 12 wherein the load measurement unit comprising: a first pressure sensor device and a second pressure sensor device;

wherein the first pressure sensor device is placed in a first space in proximity to a first side of the filter and the second pressure sensor device is placed in a second space in proximity to a second side which is in the opposite side of the first side of the filter;

wherein the first pressure sensor device measures air pressure in the first space and the second pressure sensor device measures air pressure in the second space; and wherein the measured value of the quantity of dust load accumulated on the filter is determined based on the air pressure value measured by the first pressure sensor device and the air pressure value measured by the second pressure sensor device.

18. The apparatus of claim 12 wherein the load measurement unit comprising: one or more actuators, a light source, and a light sensor;

wherein the one or more actuators place the light source and the light sensor on two opposite sides of the filter responsive to one or more actuation control signals received from the control unit;

wherein the light source and the light sensor are activated responsive to one or more light source and light sensor activation signals received from the unit control unit; and wherein the light sensor device upon activation takes a measurement of the value of a quantity of light received by the light sensor; and wherein the quantity of light is a portion of the light generated by the light source and transmitted through the filter; and wherein the measured value of the quantity of dust load accumulated on the filter is determined based on the measured value of the quantity of light received by the light sensor.

19. The apparatus of claim 12 wherein the load measurement unit comprising a timer;

wherein the timer measures a duration of time of the filter in operation; and wherein the measured value of the quantity of dust load is determined based on the duration of time.

20. A method for regenerating a filter comprising:

placing a vacuum cleaning device on or in proximity to one side of the filter;

placing a dust load measurement device on or in proximity to the filter;

measuring a first value of a quantity of dust load accumulated on the filter by the dust load measurement device either at predetermined time intervals or responsive to a dust load measurement activation signal received from a control device;

comparing the first value of a quantity of dust load to a predetermined threshold value of the quantity of dust load;

sending a cleaning activation signal to a vacuum cleaning device;

initiating a vacuum cleaning process to vacuum cleaning at least a portion of the filter by the vacuum cleaning device responsive to receiving the cleaning activation signal by the vacuum cleaning device;

wherein the vacuum cleaning process occurs without removing the filter;

wherein the vacuum cleaning device stops the vacuum cleaning process in response to either a vacuum cleaning stop signal received from the control device or the expiration of a predetermined vacuum cleaning duration; and wherein the vacuum cleaning stop signal is sent when the quantity of dust load accumulated on the filter returns back to a value within a desired range.

21. The method of claim 20 further comprising:

measuring a second value of the quantity of dust load accumulated on the filter by the dust load measurement device after the completion of vacuum cleaning of the filter;

comparing the second value with the predetermined threshold value; and generating and communicating a filter replacement alert signal to a computer server or to a user device if the second value is greater than or equal to the predetermined threshold value.

* * * * *